US007814681B2

(12) United States Patent
Wasserman

(10) Patent No.: US 7,814,681 B2
(45) Date of Patent: Oct. 19, 2010

(54) SURF BOOT WITH PASSIVE DRAINING

(75) Inventor: Darren Wasserman, 5411 Park Ave., Garden Grove, CA (US) 92845

(73) Assignee: Darren Wasserman, Garden Grove, CA (US)

( * ) Notice: Subject to any disclaimer, the term of this patent is extended or adjusted under 35 U.S.C. 154(b) by 726 days.

(21) Appl. No.: 11/787,420

(22) Filed: Apr. 14, 2007

(65) Prior Publication Data

US 2007/0240339 A1 Oct. 18, 2007

Related U.S. Application Data

(60) Provisional application No. 60/792,723, filed on Apr. 17, 2006.

(51) Int. Cl.
*A43B 5/08* (2006.01)
*A43B 7/06* (2006.01)

(52) U.S. Cl. ..... 36/8.1; 36/3 A

(58) Field of Classification Search ..... 36/8.1, 36/3 A, 3 R, 3 B; 441/61–64
See application file for complete search history.

(56) References Cited

U.S. PATENT DOCUMENTS

| | | | | |
|---|---|---|---|---|
| 4,910,887 | A * | 3/1990 | Turner et al. | 36/114 |
| 6,379,203 | B1 * | 4/2002 | Kuo | 441/64 |
| 6,408,540 | B1 * | 6/2002 | DeKalb et al. | 36/8.1 |
| 6,742,287 | B2 * | 6/2004 | DeKalb et al. | 36/8.1 |
| 7,107,702 | B1 * | 9/2006 | Chavez | 36/3 B |

FOREIGN PATENT DOCUMENTS

WO WO 2005/112679 A1 5/2005

* cited by examiner

*Primary Examiner*—Ted Kavanaugh

(57) ABSTRACT

The invention is a surf booty with integral one-way flow valves. The invention operates such that when the wearer of the boot steps onto a surface, the pressure thus directly created, with no other pumping provision, drives fluid trapped within the boot out through a valve or valves that are configured to only pass fluid in the outward direction.

6 Claims, 5 Drawing Sheets

SURF BOOT WITH PASSIVE DRAINING

RELATED APPLICATIONS

This application claims priority to U.S. provisional application Ser. No. 60/792,723, filed Apr. 17, 2006

FEDERALLY SPONSORED RESEARCH

Not Applicable

SEQUENCE LISTING

Not Applicable

BACKGROUND OF THE INVENTION

The invention is related to surf boot design and in particular the issue of surf boots filling with water during use.

Surf boots, typically made of a neoprene upper with a rubber sole, are often worn in conjunction with a full neoprene wetsuit, particularly when additional protection is required against cold water temperature and/or sharp bottom conditions. A surf boot is shown if FIG. 1. The upper portion of the boot is typically a constructed of neoprene sheet material 1 and usually this is attached to a harder rubber sole 2, the stiffness of which is carefully chosen to provide some protection against sharp bottom features while maintaining sufficient flexibility to allow for the freedom of motion necessary to engage in surfing or other water-sports. The upper ankle section is configured to elastically seal around the ankle, in some cases assisted by a strap as shown in the figure. Elements 1 and 2, with or without straps are well-known in the field of wetsuit design, and many variations are commercially available with these common elements.

Typically, the ankle section of the boot is tucked up under the leg of the wetsuit. As the wetsuit takes on water, some of the water within the wetsuit naturally flows downward, and makes it's way into the boot despite the sealing provision of most current boot designs. During the course of a surfing session, part of the time is spent standing or walking, either on the surfboard, the ocean bottom or the beach. As the boot fills up, it becomes like a water balloon around the foot, which is difficult to drain without removing the boot, often not a convenient option during the session. And of course, the boot will fill again when returned to the water as wetsuits continually take in a small amount of water by design.

All surf boots currently on the market known to the inventor exhibit this behavior. Proposed solutions have been put forth to add an active pump and valve system to surf boots, utilizing heel pumps. Although such a system may drain a boot, it is inconvenient for a number of reasons. First, the pump action of the heel is not conducive to most parts of the surfing activity. Second, surf boots become quite contaminated with sand and other debris during use, so any kind of pump is a definite reliability risk. Third, surf boots are inexpensive, long-life accessories, so a complex system is detrimental to both of these desirable attributes. To the inventor's knowledge, these disadvantages have kept active pump solutions from actually going to market.

Thus it is the object of this invention to provide a surf boot design with a simple passive provision for draining the boot during use.

BRIEF SUMMARY OF THE INVENTION

The invention is a surf boot including a boot structure adapted to be worn on a foot, and at least one valve mounted on the boot. The valve is preferably a one-way type, adapted to pass fluid out of the boot through the valve in response to an overpressure created when the boot is stepped onto an external surface In the preferred embodiment, the valve includes a first part, which has a perimeter element forming a walled opening, such that the first part is adapted to mount to the material of the boot such that the perimeter section protrudes through the boot material providing a path from the interior of the boot to the exterior. The first part also includes a shelf element, disposed around the interior wall of the perimeter element adapted to allow the top surface of the shelf element to form a planar surface within the perimeter element, and a crosspiece spanning the space within the shelf element forming spanned openings for fluid flow, disposed such that the top surface of the crosspiece is nearly co-planar with the top surface of the shelf. A flexible membrane, is sized and shaped to substantially overlap the shelf element, such that the membrane is adapted to mount to the crosspiece elements so that when pressure within the boot is higher than external pressure, the membrane will lift up off the shelf and allow fluid flow through the openings, and otherwise the membrane seals onto the planar surface formed by the shelf. Unlike other stopper valves, which typically use a sliding, essentially rigid stopper, the current valve does not rely on positive outer pressure to seal the valve, only positive inner pressure to open it. The current valve will seal well, due to the spring behavior of the membrane, during the period where the boot is immersed in water and the pressure is equal across the valve. This seal is not perfect, but since the boot is a leaky system to begin with, and hence the problem solved by the invention, the additional leak through the closed valve is typically not a significant adder to the over all amount of water which works into the boot.

A preferred version of the embodiment includes a second part disposed to mate with the first part to form a clamp holding the valve to the boot material while substantially maintaining the openings defined by the structure of the first part.

The preferred perimeter shape is circular. In the preferred embodiment, the crosspiece is formed of linear elements extending from the perimeter element or shelf element to meet in the middle of the opening defined by the perimeter element, and the center point is adapted to provide a mount for the membrane. In one version the linear elements comprise three members separating the opening into three equal area sections. In another version, the linear elements comprise four members separating the opening into four equal area sections.

In a further embodiment, the invention may include a porous or screened covering element disposed over the opening created by the perimeter wall, such that the covering element is adapted to act as debris filter and/or to limit the excursion of the membrane.

BRIEF DESCRIPTION OF THE DRAWINGS

The invention will be better understood by referring to the following figures.

DETAILED DESCRIPTION OF THE INVENTION

Figure 1:
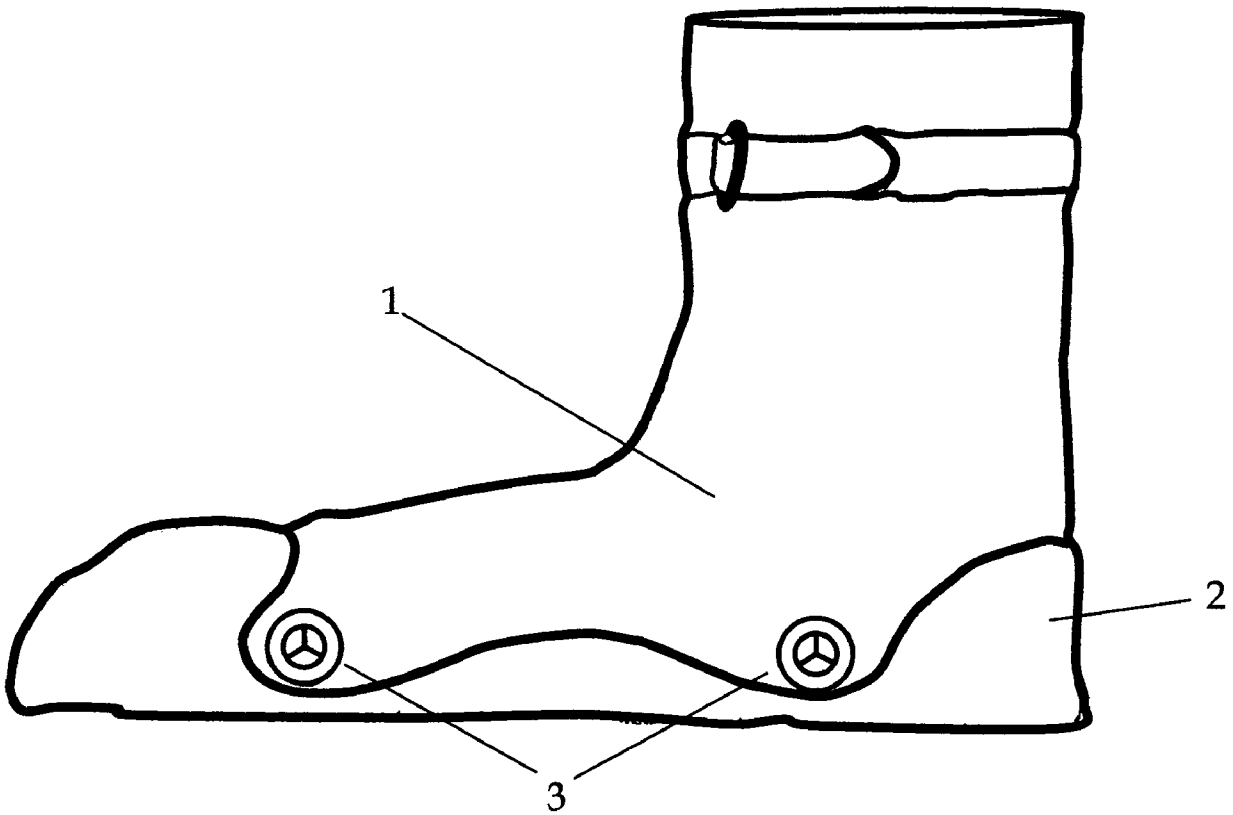
FIG. 1 depicts the common elements of a surf boot, including the elements of the invention.

The inventor has observed that when a person wearing a surf boot steps on to a surface, such as the board or beach, the pressing of the foot onto the somewhat stiff rubber sole presses the water to the side of the boot, ballooning out the sides. Therefore the natural action of stepping on the boot with no pumping device creates an overpressure of the trapped fluid within the boot relative to the outside. Thus the inventor has designed a boot with al least one, preferably two or more, one-way valves shown in FIG. 1 at 3. A variety of mounting locations is possible, as long as the valve is mounted in the lower portion of the boot. With a properly chosen valve, the action of standing or walking causes the entrapped fluid to exit through the valve, resulting in substantially draining the boot. This action beneficially occurs during the part of the activity where the entrapped fluid is a problem.

A preferred valve and it's operation are depicted in FIGS. 2-5. A two part valve with circular shape and a trisect crosspiece are shown in all of the figures. This configuration is preferred by the inventor for aesthetic, manufacturability, and assembly reasons. However one skilled in the art will recognize variations in shape and part configuration as workable alternatives, and such alternatives are within the scope of the invention.

Figure 2:
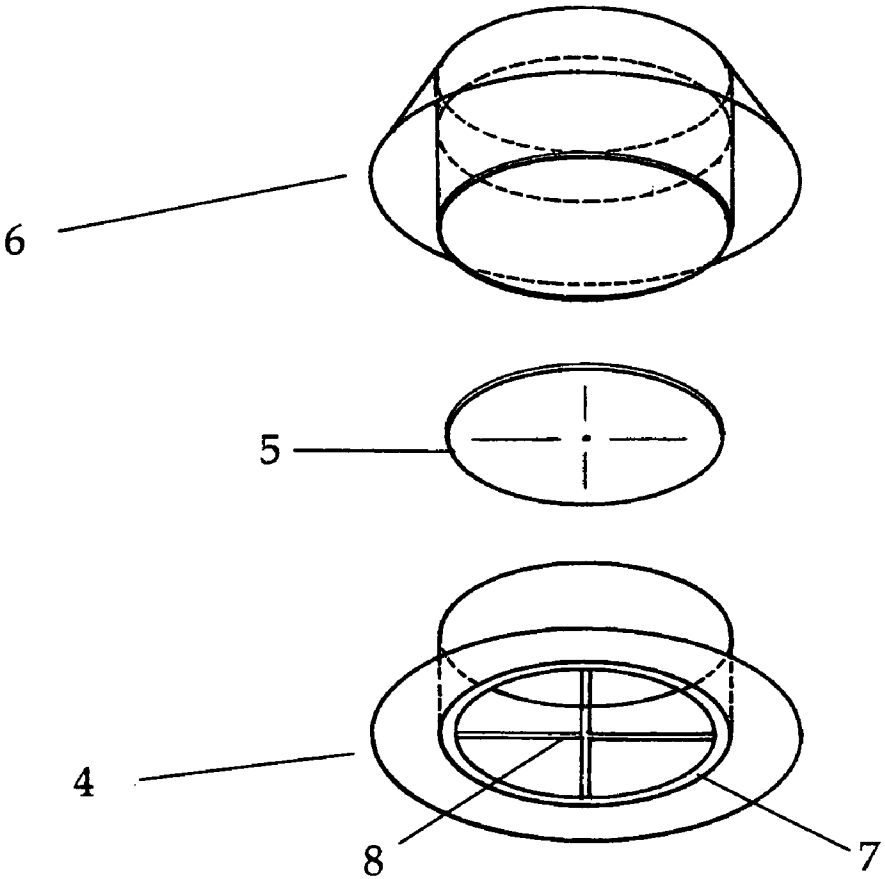
FIG. 2 is a three dimensional depiction of the preferred valve.

Referring to FIG. 2, a first part 4 consists of a perimeter (cylindrical as shown) wall, intended to pierce the material of the boot, forming a flow channel from the interior of the boot to the exterior. Within the wall is a shelf 7, preferably a flat lip near the bottom (interior of the boot) end of the perimeter wall. The opening within the wall is spanned by a crosspiece 8, shown as a trisect. This crosspiece should be near coplanar with the flat surface of the lip. In this drawing the crosspieces and shelf form a planar top surface, spanning the interior of the perimeter, leaving flow openings.

A flexible membrane or stopper, 5 is attached, preferably at the center of the crosspiece. The membrane is sized to overlap the shelf but fit within the perimeter, such that when flat, the membrane closes off the flow channel. In the operation of the valve, the overpressure of the internal fluid occurring when the wearer of the boot steps on a surface causes membrane 5 to flare up, allowing fluid to flow out of the boot. Thus it is clear that there is a range of variation in the relative height of the crosspiece and shelf that could be accommodated by a flexible membrane, so strict co-planarity is not a required limitation.

Figure 3:
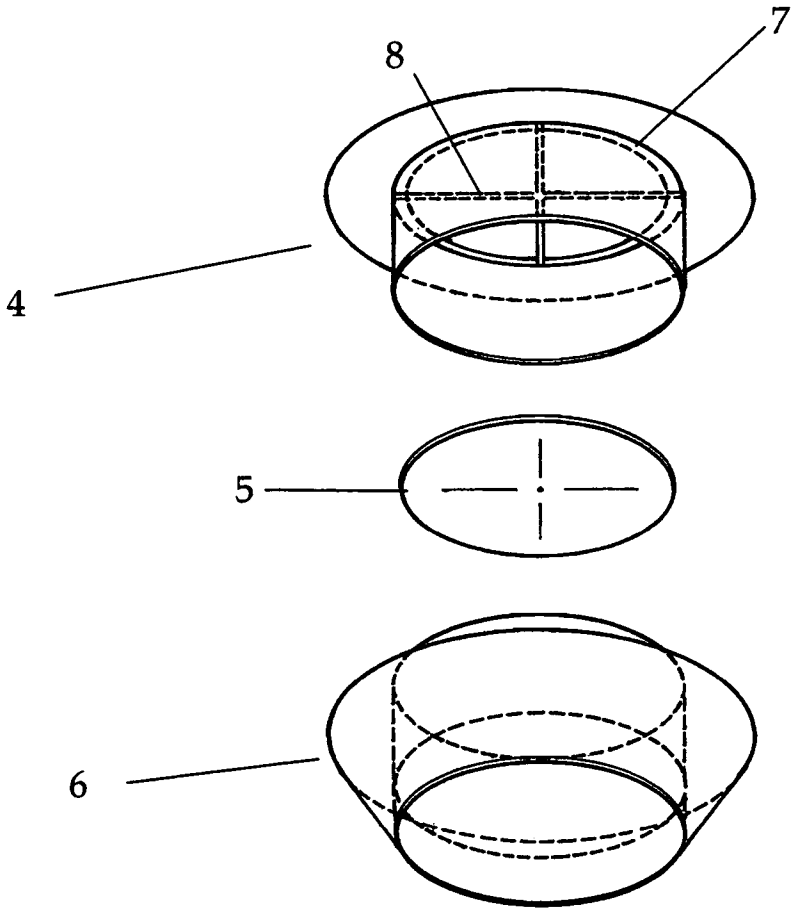
FIG. 3 is another three dimensional depiction of the preferred valve.

The preferred mounting of the valve utilizes a second part 6. Other ways to mount the part 4 and stopper 5 will suggest themselves to a skilled practitioner and are within the scope of the invention. For clarity, the arrangement of parts from an alternative angle is shown in FIG. 3.

Figure 4:
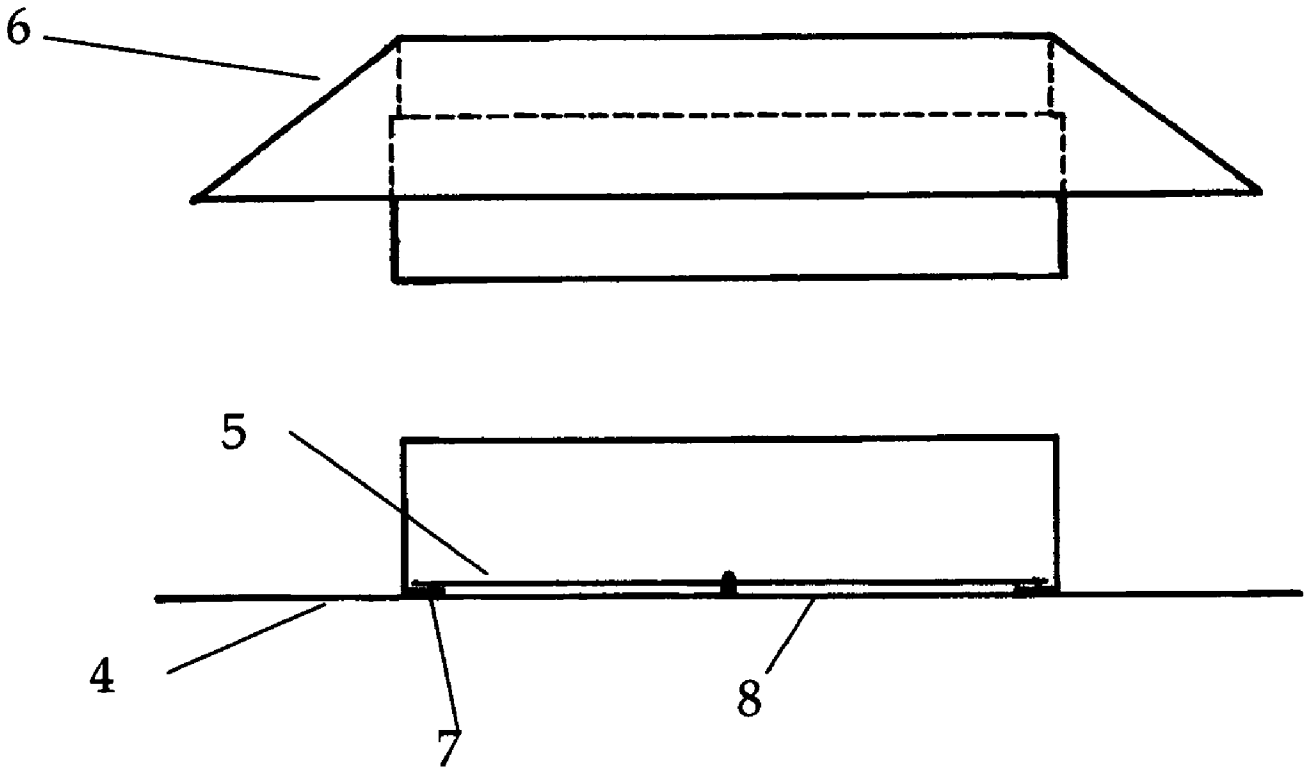
FIG. 4 is a cross-sectional depiction of the preferred valve.
Figure 5:
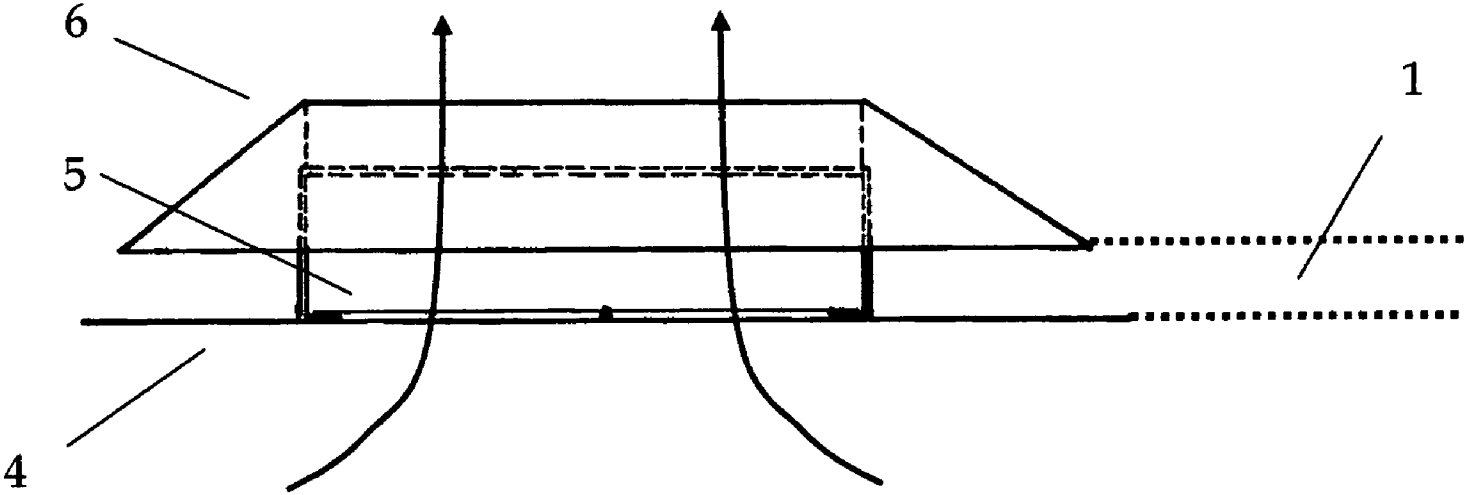
FIG. 5 is a cross-sectional depiction of the preferred valve attached to the boot material.

A detailed description of a preferred valve will now be described by referring to FIGS. 4 and 5. The preferred valve is a small rivet-like two part, 4 and 6, hollow structure made of a hard plastic or similar material, including a rubber, or other flexible material, membrane 5. The outer rim of the top part 6 is beveled outward and seals the outer edge of the outside of the hole punched in the boot to mount the valve. The bottom part 4, or inside part, is flanged at its base and seals against the outer edge of the inside of the hole punched in the boot to mount the valve. The operation of the membrane, shelf and crosspiece are as described above. The valve as assembled onto the boot material 1 and water flow during operation are shown in FIG. 5. Note that in FIGS. 4 and 5, the crosspiece 8 is shown as extending from the bottom of a thin shelf element 7, as opposed to being strictly coplanar as shown in FIGS. 2 and 3, illustrating the type of variability possible.

It may be desirable to fit either the top, bottom or both ends of the valve wall with a screen or other element to prevent debris from clogging the valve. Such an element could also limit the excursion of the membrane

I claim:

1. A surf boot, comprising;

a boot structure adapted to be worn on a foot, and at least one valve mounted on the boot, wherein the valve is a one-way type, adapted to pass fluid out of the boot through the valve in response to an overpressure created when the boot is stepped onto an external surface, wherein the valve comprises; a first part, comprising;

a perimeter element forming a walled opening, wherein the first part is adapted to mount to a material of the boot such that the perimeter element protrudes through the boot material providing a path from an interior of the boot to an exterior, a shelf element, disposed around the interior wall of the perimeter element adapted to allow a top surface of the shelf element to form a planar surface within the perimeter element, a crosspiece spanning the space within the shelf element forming spanned openings for fluid flow, disposed such that the top surface of the crosspiece is nearly co-planar with the top surface of the shelf, and;

a second part disposed to mate with the first part to form a clamp holding the valve to the boot material while substantially maintaining the openings defined by the structure of the first part, and;

a flexible membrane, sized and shaped to substantially overlap the shelf element, wherein the membrane is adapted to mount to the crosspiece elements in a manner such that when pressure within the boot is higher than external pressure, the membrane will lift up off the shelf and allow fluid flow through the openings, and otherwise the membrane seals onto the planar surface formed by the shelf.

2. The boot of claim 1 wherein the perimeter shape is circular.

3. The boot of claim 1 wherein the crosspiece is formed of linear elements extending from the perimeter element or shelf element to meet in the middle of the opening defined by the perimeter element, and the center point is adapted to provide a mount for the membrane.

4. The boot of claim 3 wherein the linear elements comprise three members separating the opening into three equal area sections.

5. The boot of claim 3 wherein the linear elements comprise four members separating the opening into four equal area sections.

6. The boot of claim 1 further comprising a porous or screened covering element disposed over one or both openings created by the perimeter wall, wherein the covering element is adapted to act as debris filter and/or to limit the excursion of the membrane.

* * * * *